US009938735B2

(12) United States Patent
Gower

(10) Patent No.: US 9,938,735 B2
(45) **Date of Patent: *Apr. 10, 2018**

(54) SLIDABLE BARRIERS

(71) Applicant: Ted Gower, North Palm Beach, FL (US)

(72) Inventor: Ted Gower, North Palm Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/227,488

(22) Filed: Aug. 3, 2016

(65) Prior Publication Data

US 2017/0058542 A1 Mar. 2, 2017

Related U.S. Application Data

(63) Continuation of application No. 14/698,824, filed on Apr. 28, 2015, now Pat. No. 9,422,732.
(Continued)

(51) Int. Cl.
*E04B 1/00* (2006.01)
*E04G 21/32* (2006.01)
(Continued)

(52) U.S. Cl.
CPC ..... *E04G 21/3219* (2013.01); *E04B 2/721* (2013.01); *E04B 2/74* (2013.01);
(Continued)

(58) Field of Classification Search
CPC ..... E04H 15/646; E04H 15/322; E04H 4/108; E04B 9/303; E04B 2009/0492; E04B 2002/7479; F16B 5/0692; E04F 13/005; E04F 10/02; E04F 13/00; E04F 13/0814; Y10S 135/907; Y10S 160/07; E04G 21/3247; E04G 21/3204; E04G 21/3266; E04G 21/3233; E01F 13/022
See application file for complete search history.

(56) References Cited

U.S. PATENT DOCUMENTS 838,867 A 12/1906 Lalus
1,003,966 A 9/1911 Lathrop
(Continued)

FOREIGN PATENT DOCUMENTS

JP 11200178 A 7/1999
JP 2000054241 2/2000
WO 2004018821 A1 3/2004

*Primary Examiner* — Gisele D Ford
(74) *Attorney, Agent, or Firm* — Darrow Mustafa PC

(57) ABSTRACT

Slidable barrier arrangements for a structure having a plurality of stories are described. A first retainer element can be operatively connected to the structure. The retainer element can span a plurality of stories of the structure. The retainer element can include a plurality of retainer segments, including an uppermost retainer segment and one or more lower retainer segments. The one or more lower retainer segments can include a lowermost retainer segment. A barrier and the first retainer element can be brought together such that a portion of the barrier is retainably engaged by the lower retainer segments of the first retainer element. The length of the barrier can substantially correspond to the length of the lower retainer segments. Thus, the uppermost retainer segment can extend vertically above an upper edge side of the barrier. The barrier can be selectively moved, such as by sliding, within the first retainer element.

6 Claims, 10 Drawing Sheets

Related U.S. Application Data

(60) Provisional application No. 61/984,875, filed on Apr. 28, 2014.

(51) Int. Cl.

| | |
|---|---|
| ***E04G 21/28*** | (2006.01) |
| ***E04B 2/72*** | (2006.01) |
| ***E04B 2/74*** | (2006.01) |
| *E04G 21/24* | (2006.01) |

(52) U.S. Cl.

CPC ..... *E04G 21/28* (2013.01); *E04G 21/3233* (2013.01); *E04G 21/3247* (2013.01); *E04G 21/3266* (2013.01); *E04B 2002/7461* (2013.01); *E04G 2021/248* (2013.01)

(56) References Cited

U.S. PATENT DOCUMENTS

| | | | |
|---|---|---|---|
| 2,189,567 | A | 2/1940 | Miller |
| 2,287,667 | A | 6/1942 | Brown |
| 2,825,941 | A | 3/1958 | Lux et al. |
| 2,835,935 | A | 5/1958 | Housley |
| 2,886,481 | A | 5/1959 | Swan |
| 2,950,727 | A | 8/1960 | Dunn |
| 2,986,150 | A | 5/1961 | Torian |
| 3,051,232 | A | 8/1962 | Lamb |
| 3,121,470 | A | 2/1964 | Stone et al. |
| 3,201,171 | A | 8/1965 | Wickard |
| 3,480,069 | A | 11/1969 | Handwerker |
| 3,720,438 | A | 3/1973 | Johnson et al. |
| 3,762,110 | A | 10/1973 | Boss, Jr. |
| 3,805,816 | A | 4/1974 | Nolte |
| 3,862,876 | A | 1/1975 | Graves |
| 3,875,623 | A | 4/1975 | Johnston |
| 3,949,527 | A | 4/1976 | Double et al. |
| 3,995,715 | A | 12/1976 | Virtanen |
| 4,036,244 | A | 7/1977 | Huddle |
| 4,088,173 | A | 5/1978 | Antich |
| 4,098,035 | A | 7/1978 | Bessler |
| 4,107,826 | A | 8/1978 | Tysdal |
| 4,133,366 | A | 1/1979 | Jenkins, Sr. |
| 4,137,687 | A | 2/1979 | Sprung |
| 4,182,088 | A | 1/1980 | Ball |
| 4,233,790 | A | 11/1980 | Meadows |
| 4,258,517 | A | 3/1981 | Hammond |
| 4,261,144 | A | 4/1981 | Rizzo |
| 4,265,039 | A | 5/1981 | Brooks |
| 4,283,888 | A | 8/1981 | Cros |
| 4,299,507 | A | 11/1981 | Collins, II |
| 4,337,815 | A | 7/1982 | Lindstrom |
| 4,397,122 | A | 8/1983 | Cros |
| 4,441,290 | A | 4/1984 | Abell |
| 4,571,897 | A | 2/1986 | Kerr |
| 4,583,331 | A | 4/1986 | Hunt et al. |
| 4,590,714 | A | 5/1986 | Walker |
| RE32,509 | E | 9/1987 | Werner |
| 4,744,403 | A | 5/1988 | Hausmann et al. |
| 4,805,357 | A | 2/1989 | Aleixo |
| 4,825,921 | A | 5/1989 | Rigter |
| 4,858,395 | A | 8/1989 | McQuirk |
| 4,887,626 | A | 12/1989 | Dalo et al. |
| 4,903,629 | A | 2/1990 | Maudlin et al. |
| 4,909,299 | A | 3/1990 | Bussert |
| 4,930,834 | A | 6/1990 | Moore |
| 5,010,944 | A | 4/1991 | Bussert |
| 5,026,109 | A | 6/1991 | Merlot, Jr. |
| 5,038,889 | A | 8/1991 | Jankowski |
| 5,042,551 | A | 8/1991 | Ein et al. |
| 5,058,299 | A | 10/1991 | Suzuki |
| 5,086,604 | A | 2/1992 | Orth |
| 5,123,474 | A | 6/1992 | Smith |
| 5,161,641 | A | 11/1992 | Nusbaum |
| 5,181,354 | A | 1/1993 | Krueger et al. |
| 5,197,239 | A | 3/1993 | Glynn et al. |
| 5,259,323 | A | 11/1993 | Koch et al. |
| 5,333,425 | A | 8/1994 | Nickerson et al. |
| 5,343,668 | A | 9/1994 | Gonzalez |
| 5,347,768 | A | 9/1994 | Pineda |
| 5,373,653 | A | 12/1994 | Suzuki |
| 5,396,739 | A | 3/1995 | Venegas, Jr. |
| 5,398,436 | A | 3/1995 | Suzuki |
| 5,402,988 | A | 4/1995 | Eisele |
| 5,408,770 | A | 4/1995 | Suzuki |
| 5,430,982 | A | 7/1995 | Bane |
| 5,477,646 | A | 12/1995 | Dietz et al. |
| 5,507,109 | A | 4/1996 | Rinzler |
| 5,522,184 | A | 6/1996 | Oviedo-Reyes |
| 5,555,681 | A | 9/1996 | Cawthon |
| 5,595,233 | A | 1/1997 | Gower |
| 5,601,129 | A | 2/1997 | Colson et al. |
| 5,603,190 | A | 2/1997 | Sanford |
| 5,613,543 | A | 3/1997 | Walton |
| 5,702,147 | A | 12/1997 | Essig |
| 5,784,842 | A | 7/1998 | Wackerbauer |
| 5,791,090 | A | 8/1998 | Gitlin et al. |
| 5,809,709 | A | 9/1998 | Ryan et al. |
| 5,845,423 | A | 12/1998 | Hicks |
| 5,852,903 | A | 12/1998 | Astrizky |
| 5,937,595 | A | 8/1999 | Miller |
| 5,953,875 | A | 9/1999 | Harkins |
| 5,966,877 | A | 10/1999 | Hawes |
| 6,003,583 | A | 12/1999 | Lacoste et al. |
| 6,079,473 | A | 6/2000 | Ackerson, II et al. |
| 6,101,751 | A | 8/2000 | Hick |
| 6,138,738 | A | 10/2000 | Moller et al. |
| 6,141,921 | A | 11/2000 | Leeuwenburgh et al. |
| 6,141,922 | A | 11/2000 | Carlisle et al. |
| 6,145,525 | A | 11/2000 | Mooney |
| 6,155,009 | A | 12/2000 | Pena |
| 6,176,050 | B1 | 1/2001 | Gower |
| 6,209,271 | B1 | 4/2001 | Kovacs |
| 6,230,455 | B1 | 5/2001 | Arehart et al. |
| 6,296,041 | B1 | 10/2001 | Cicero |
| 6,314,684 | B1 | 11/2001 | Aviram |
| 6,324,797 | B1 | 12/2001 | Fago et al. |
| 6,325,085 | B1 | 12/2001 | Gower |
| 6,338,226 | B1 | 1/2002 | Gauthier et al. |
| 6,341,455 | B1 | 1/2002 | Gunn |
| 6,367,781 | B1 | 4/2002 | Flynn et al. |
| 6,393,777 | B1 | 5/2002 | Renfrow |
| 6,412,540 | B2 | 7/2002 | Hendee |
| 6,502,355 | B1 | 1/2003 | Bori |
| 6,513,272 | B2 | 2/2003 | Richards et al. |
| 6,532,703 | B1 | 3/2003 | Barrens |
| 6,588,159 | B1 | 7/2003 | Cotton, Jr. |
| 6,698,123 | B2 | 3/2004 | Smith |
| 6,782,646 | B1 | 8/2004 | Devaney |
| 6,848,492 | B2 | 2/2005 | Thomas |
| 6,865,852 | B2 | 3/2005 | Gower |
| 6,886,299 | B2 | 5/2005 | Gower |
| 6,886,300 | B2 | 5/2005 | Hudoba et al. |
| 6,898,907 | B2 | 5/2005 | Diamond |
| 6,904,720 | B1 | 6/2005 | Adolfson et al. |
| 6,966,152 | B2 | 11/2005 | Glynos |
| 6,978,579 | B1 | 12/2005 | Trinca |
| 7,063,227 | B2 | 6/2006 | Looker |
| 7,069,700 | B2 | 7/2006 | Heissenberg |
| 7,159,349 | B2 | 1/2007 | Uccello et al. |
| 7,185,693 | B1 | 3/2007 | Hines |
| 7,225,882 | B2 | 6/2007 | Miller et al. |
| 7,260,908 | B2 | 8/2007 | Devaney |
| 7,275,340 | B2 | 10/2007 | Andrews et al. |
| 7,325,365 | B2 | 2/2008 | Warner |
| 7,392,620 | B1 | 7/2008 | Watson, Jr. |
| 7,406,802 | B2 | 8/2008 | Stackenwalt et al. |
| 7,610,727 | B2 | 11/2009 | Toledo |
| 7,871,052 | B2 | 1/2011 | Baum |
| 7,987,863 | B2 | 8/2011 | Warner |
| 8,051,868 | B2 | 11/2011 | Whitlow |
| 8,082,970 | B2 | 12/2011 | Gower |
| 8,393,055 | B2 | 3/2013 | Gower |
| 8,505,263 | B2 | 8/2013 | Gower |
| 2001/0015038 | A1 | 8/2001 | Cadalso |

(56) References Cited

U.S. PATENT DOCUMENTS

| | | | |
|---|---|---|---|
| 2002/0007924 | A1 | 1/2002 | Hendee |
| 2002/0017065 | A1 | 2/2002 | Clewis |
| 2002/0100221 | A1 | 8/2002 | Williams |
| 2002/0134414 | A1 | 9/2002 | Gower |
| 2003/0019179 | A1 | 1/2003 | Colson et al. |
| 2003/0127122 | A1 | 7/2003 | Gower |
| 2003/0159372 | A1 | 8/2003 | Motro |
| 2003/0208963 | A1 | 11/2003 | Morris |
| 2004/0074153 | A1 | 4/2004 | Ceria |
| 2004/0107655 | A1 | 6/2004 | Hudoba |
| 2004/0154242 | A1 | 8/2004 | Hudoba et al. |
| 2004/0159345 | A1 | 8/2004 | Gower |
| 2004/0250477 | A1 | 12/2004 | Butcher |
| 2005/0011133 | A1 | 1/2005 | Meyer |
| 2005/0076589 | A1 | 4/2005 | Mills et al. |
| 2005/0279465 | A1 | 12/2005 | Gower |
| 2006/0225960 | A1 | 10/2006 | Ferlin et al. |
| 2006/0260226 | A1 | 11/2006 | Gower |
| 2007/0204533 | A1 | 9/2007 | Gower |
| 2008/0034684 | A1 | 2/2008 | Morris et al. |
| 2008/0148684 | A1 | 6/2008 | Bruder |
| 2008/0289281 | A1 | 11/2008 | Greiner |
| 2010/0037544 | A1 | 2/2010 | Musgrave et al. |
| 2010/0295007 | A1 | 11/2010 | Preston |
| 2011/0171336 | A1 | 7/2011 | Schwoerer |
| 2013/0001493 | A1 | 1/2013 | Svedberg |
| 2013/0168626 | A1 | 7/2013 | Blinn |
| 2013/0186008 | A1 | 7/2013 | Gower |

SLIDABLE BARRIERS

CROSS-REFERENCE TO RELATED APPLICATIONS

This application is a continuation of U.S. patent application Ser. No. 14/698,824, filed on Apr. 28, 2015, which claims the benefit of U.S. Provisional Application No. 61/984,875, filed on Apr. 28, 2014, which both of which are incorporated herein by reference in their entirety.

FIELD

The subject matter described herein relates in general to barriers, and, more particularly, to the use of barriers in connection with structures having a plurality of stories.

BACKGROUND

Barriers can be used to protect objects, structures, people and/or other things located on one or both sides of the barrier. For example, during the construction of a high rise building, building enclosure tarps are used to temporarily cover the outside of the building. Such tarps can protect worker from exposure to the weather (e.g., sun, wind, rain, etc.). Such tarps can also create a barrier between the construction site and the public, thereby preventing objects and debris from falling into public areas and providing safety for construction personnel.

SUMMARY

In one respect, the present disclosure is directed to a slidable barrier method for a structure having a plurality of stories. The method can include operatively connecting a first retainer element to the structure. The first retainer element can extend in a substantially vertical direction. The first retainer element can span a plurality of stories of the structure. The first retainer element can include a plurality of retainer segments. The plurality of retainer segments can include an uppermost retainer segment and one or more lower retainer segments. The one or more lower retainer segments can include a lowermost retainer segment.

The method can also include bringing a barrier and the first retainer element together such that a portion of the barrier is retainably engaged with the one or more lower retainer segments of the first retainer element. The barrier can have an associated length. The length of the barrier can substantially correspond to a length of the lower retainer segments. The uppermost retainer segment can extend above an upper edge side of the barrier in the substantially vertical direction.

The method can include moving the barrier upwardly within the first retainer element such that the barrier is retainably engaged with the uppermost retainer segment and such that the barrier is no longer retainably engaged with the lowermost retainer segment. The method can further include disconnecting the lowermost retainer segment from the structure. The method can include operatively connecting the disconnected retainer segment to the structure in a location above the uppermost retainer segment in the substantially vertical direction to become a new uppermost retainer segment. As a result, the barrier is not retainably engaged by the new uppermost retainer segment, and the previous uppermost retainer segment can become included in the one or more lower retainer segments.

In another respect, the present disclosure is directed to a system. The system can include a structure having a plurality of stories. The system can include a first retainer element operatively connected to the structure. The first retainer element can span a plurality of stories of the structure. The first retainer element can include a plurality of retainer segments. The plurality of retainer segments can include an uppermost retainer segment and one or more lower retainer segments. The one or more lower retainer segments can include a lowermost retainer segment.

The system can include a second retainer element operatively connected to the structure. The second retainer element can span a plurality of stories of the structure. The second retainer element can include a plurality of retainer segments. The plurality of retainer segments can include an uppermost retainer segment and one or more lower retainer segments. The one or more lower retainer segments can include a lowermost retainer segment.

The system can also include a barrier. The barrier can have an associated length. The length of the barrier can substantially correspond to a plurality of stories (n) of the structure but less than all of the plurality of stories of the structure. A portion of the barrier can be retainably engaged with the one or more lower retainer segments of the first retainer element. An opposite portion of the barrier can be retainably engaged with the one or more lower retainer segments of the second retainer element. The length of the barrier can substantially correspond to a length of the lower retainer segments. The uppermost retainer segment of the first retainer element can extend above an upper edge side of the barrier in the substantially vertical direction. The uppermost retainer segment of the second retainer element can extend above the upper edge side of the barrier in the substantially vertical direction.

DETAILED DESCRIPTION

Arrangements described herein relate to systems, methods, apparatuses and/or kits for barriers. Such barriers can be used in connection with structures having a plurality of stories. Arrangements described herein can permit the barriers to be slidable relative to the structure. Detailed embodiments are disclosed herein; however, it is to be understood that the disclosed embodiments are intended only as exemplary. Therefore, specific structural and functional details disclosed herein are not to be interpreted as limiting, but merely as a basis for the claims and as a representative basis for teaching one skilled in the art to variously employ the aspects herein in virtually any appropriately detailed structure. Further, the terms and phrases used herein are not intended to be limiting but rather to provide an understandable description of embodiments and aspects herein. Arrangements are shown in FIGS. 1-13, but the embodiments are not limited to the illustrated structure or application.

For purposes of simplicity and clarity of illustration, elements shown in the figures have not necessarily been drawn to scale. For example, the dimensions of some of the elements may be exaggerated relative to other elements for clarity. Further, where considered appropriate, reference numbers are repeated among the figures to indicate corresponding, analogous, or like features. In addition, numerous specific details are set forth in order to provide a thorough understanding of the embodiments described herein. However, it will be understood by those of ordinary skill in the art that the embodiments described herein can be practiced without these specific details.

Figure 1:
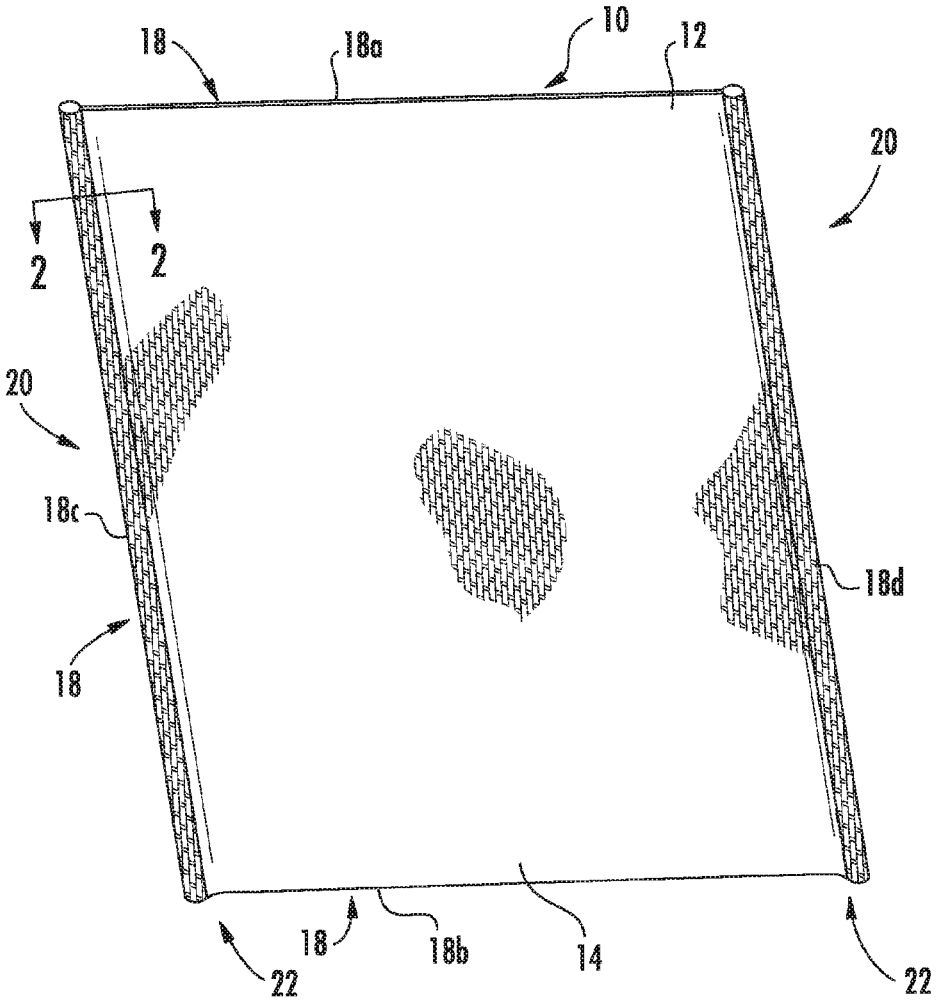
FIG. 1 is an example of a barrier.

Arrangements described herein can include a barrier. FIG. 1 shows an example of a barrier 10. As used herein, a "barrier" is defined as any physical structure that prevents, blocks, hinders, obstructs, bars, minimizes and/or impedes the passage of a force, object, and/or thing through it. The barrier 10 can be a manmade physical structure, that is, a structure that is manufactured, created, constructed or built by humans, as opposed to occurring in nature.

The barrier 10 can be made of any suitable material. The barrier 10 can have a main body 12. The main body 12 can be a single panel of material, or the main body 12 can include a plurality of main body panel elements (e.g. a plurality of pieces of material) that are joined in any suitable manner. The main body 12 can include one or more layers. The barrier 10 can be made of a flexible material. In one or more arrangements, the barrier 10 can be made of a material that enables the barrier 10 to be rolled, coiled and/or folded for storage or other purposes.

The barrier 10 can have any suitable size, shape and/or thickness. In one or more implementations, the barrier 10 can be substantially rectangular. As used herein, the term "substantially" includes exactly the term it modifies and slight variations therefrom. Thus, the term "substantially rectangular" means exactly rectangular and slight variations therefrom. In arrangements in which the barrier 10 is substantially rectangular, the barrier 10 can have an associated length and an associated width. In one or more arrangements, the length of the barrier 10 can be about 12 meters or less. In one or more arrangements, the width of the barrier 10 can be about 8.4 meters or less. However, it will be understood that such dimensions are provided merely as examples, and arrangements described herein are not limited to these dimensions.

Further, while arrangements presented herein will be described in connection with a substantially rectangular barrier, it will be understood that the barrier is not limited to such a shape. Indeed, other shapes for barrier 10 are possible. For instance, barrier 10 can be substantially triangular, substantially square, substantially polygonal, substantially trapezoidal, substantially circular, substantially oval, substantially parallelogram, or substantially rhombus, just to name a few possibilities. Further, the barrier 10 can be any irregular shape. The barrier 10 can be symmetrical. Alternatively, the barrier 10 can be asymmetrical.

In one or more implementations, the barrier 10 can be made from a textile woven of a suitable fiber. As an example, the barrier 10 can be made of polypropylene formed in a monofilament and woven into geotextile, such as style 20458 manufactured by Synthetic Industries of Gainesville, Ga. Various examples of suitable materials for the barrier 10 and associated characteristics and/or properties are described in U.S. Pat. Nos. 6,176,050; 6,325,085; 6,886,299; 6,865,852; 8,393,055; 8,082,970; and 8,505,263 and U.S. Patent Application Publication Nos. 2005/0279465 and 2013/0186008, each of which is incorporated herein by reference. In one or more arrangements, the barrier 10 can be a made of a flexible material. In one or more arrangements, the barrier 10 can be made of a rigid material. In one or more arrangements, the barrier 10 can be substantially solid or otherwise substantially non-porous. In one or more arrangements, the barrier 10 can be porous. In one or more arrangements, the barrier 10 can have a porosity of at least about 5 percent. In one or more arrangements, the barrier 10 can be about 95 percent or more closed.

The barrier 10 can include opposing major sides. For instance, the barrier 10 can include an outer major side 14 and an inner major side 16. The terms "inner" and "outer" are used merely for convenience to indicate the relative position of the major sides relative to the structure or object that the barrier 10 is being attached to, positioned with respect to, and/or otherwise used in connection with. However, the use of these terms is not intended to be limiting. Thus, the inner major side 16 can face toward the structure or object, and the outer major side 14 can face away from the structure or object.

The barrier 10 can have one or more edge sides 18. For instance, there can be an upper edge side 18*a*, a lower edge side 18*b*, a first lateral edge side 18*c*, and a second lateral edge side 18*d*. The terms "upper", "lower", and "lateral" are used merely for convenience to indicate the relative position of these edge sides when the barrier 10 is in an operative position as described herein. However, the use of these terms is not intended to be limiting.

The barrier 10 can include one or more edge regions 20. Each edge region 20 can include a respective one of the edge sides 18. In the case of a substantially rectangular barrier, as is shown in FIG. 1, the barrier 10 can have four edge sides 18 and four edge regions 20. However, it will be understood that the quantity of edge sides 18 and edge regions 20 will vary depending on the shape of the barrier 10.

At least one of the edge regions 20 can be configured to be retainably engaged by a retainer element. "Retainably engaged" and variants thereof means any direct or indirect engagement such that the items are held in a desired position relative to each other. In this way, the barrier 10 can be held in a desired place. However, the barrier 10 can be readily removed or moved when desired.

Figure 2:
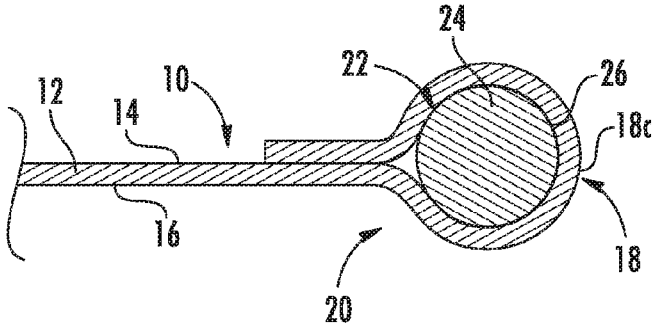
FIG. 2 is a cross-sectional view of an example of an edge region of a barrier, viewed along line 2-2 in FIG. 1.

The edge regions 20 can be configured to be retainably engaged by a retainer element in any suitable manner. As an example, the edge regions 20 can include a bulging element 22 (FIG. 2). In one or more implementations, the bulging element 22 can be a cord-like member 24. The cord-like member 24 can be associated with the edge region 20 of the barrier 10 in any suitable manner. For instance, the cord-like member 24 can be attached to the barrier 10, such as by bonding, sewing, stitching, fasteners, adhesives, and/or mechanical engagement, just to name a few possibilities. In one arrangement, the cord-like member 24 can be enclosed within a pocket 26 formed in an edge region 20 of the barrier 10. An example of such an arrangement is shown in FIG. 2. The pocket 26 can be formed in any suitable manner, such as by folding over a portion of the main body 12 of the barrier 10 upon itself (as shown in FIG. 2) and/or by the attachment of another piece of material to the main body 12.

In one or more arrangements, the cord-like member 24 can extend continuously along or near at least a portion of a respective edge side 18 of the barrier 10. The cord-like member 24 can have any suitable cross-sectional shape. In one or more arrangements, the cord-like member 24 can have a substantially circular cross-sectional shape. However, other cross-sectional shapes are possible for the cord-like member 24. For instance, the cord-like member 24 can have a substantially rectangular, substantially polygonal, substantially triangular, substantially oval, substantially parallelogram, or irregular cross-sectional shape. The cord-like member 24 can have any suitable cross-sectional size.

In one or more implementations, the cord-like member 24 can be a single, continuous structure. Alternatively, the cord-like member 24 can include a plurality of segments. In such case, the plurality of segments can be arranged in a substantially abutted manner. Alternatively, one or more pairs of neighboring segments can be spaced apart from each other.

The cord-like member 24 can be made of any suitable material. In one or more arrangements, the cord-like member 24 can be made of a material that is resistant to compression. Alternatively or in addition, the cord-like member 24 can be made of a material that allows it to be rolled, unrolled, coiled, uncoiled, folded and/or unfolded.

Again, the cord-like member 24 is merely one example of the bulging element 22, which, in turn, is merely one way of configuring an edge region 20 of the barrier 10 to be retainably engaged by a retainer element. Thus, it will be understood that embodiments are not limited to these configurations and/or arrangements and that other configurations and/or arrangements are possible.

The barrier 10 can be operatively connected to a structure. The term "operatively connected," as used throughout this description, can include direct or indirect connections, including connections without direct physical contact. The barrier 10 can be operatively connected to any portion of the structure (e.g. the walls of a structure, the floor, the ground, slabs, framework, etc.).

The structure can be any suitable structure. In one or more arrangements, the structure can be a building with a plurality of stories (e.g., floors or levels). As an example, the building can be a low-rise building, a mid-rise building, or a high-rise building. In one or more arrangements, the building can be a habitable structure, that is, a structure that is intended for human use (e.g., living, work, recreation, etc.). In one or more arrangements, the structure or a portion of the structure may not be intended for human use. In one or more arrangements, the structure can be a building under construction.

The barrier 10 can have one or more features to facilitate its use in connection with the structure. As one example, the barrier 10 can include one or more features that can help to relieve pressure that may build up within the structure. For instance, the barrier 10 can include one or more pressure relief slits, flaps, and/or vents (not shown). Such pressure relief slits, flaps, and/or vents can be provided by providing cuts in the main body 12 of the barrier 10. The pressure relief slits, flaps, and/or vents can have any suitable size, shape, and/or configuration. The one or more pressure relief slits, flaps, and/or vents can be provided in any suitable location on the barrier 10. Thus, if sufficient pressure builds up in the structure or in the space between the structure and the barrier 10, the pressure relief slit(s), flap(s) or vent(s) can open to allow fluid communication with the outside environment, thereby relieving at least some of the pressure.

The barrier 10 can be operatively connected to a structure in any suitable manner. For instance, in one or more arrangements, the barrier 10 can be operatively connected to a structure by one or more retainer elements. In one or more arrangements, the barrier 10 can be retained in place by at least two retainer elements. In one or more arrangements, the barrier 10 can be operatively connected to and/or about at least a portion of an exterior of the structure.

Figure 3:
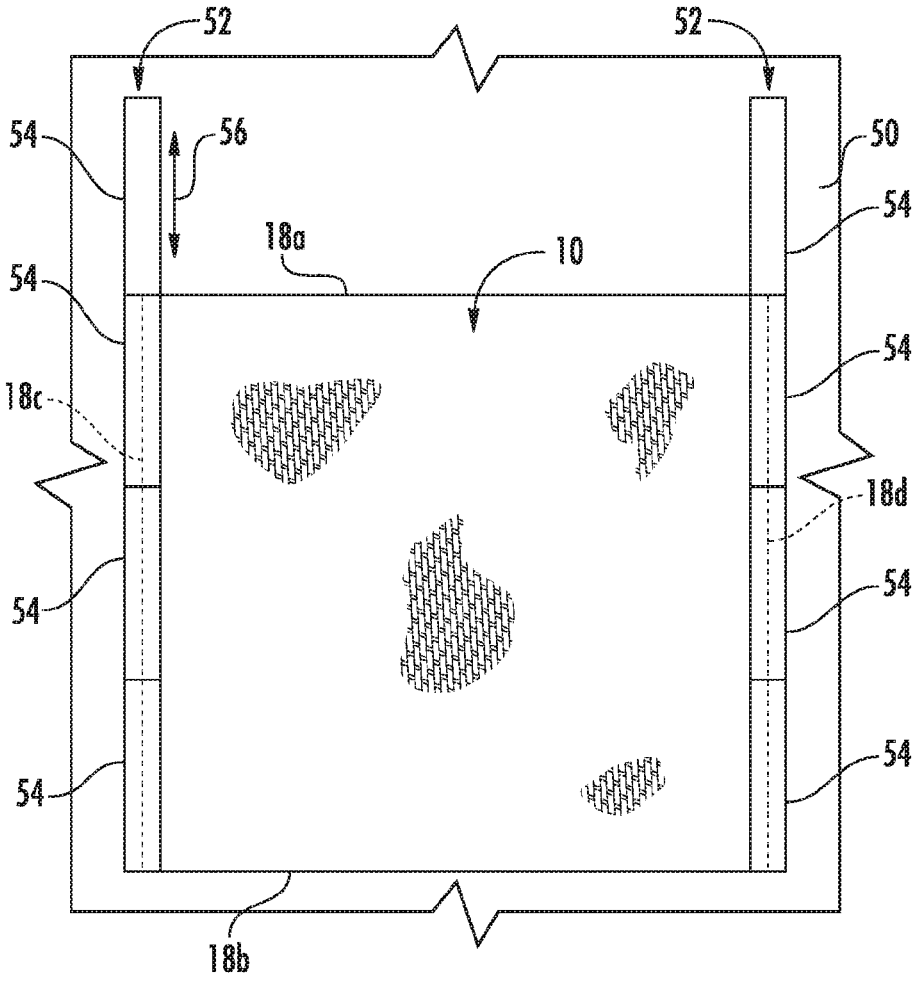
FIG. 3 is a side elevation view of a portion of a structure, showing a barrier operatively connected to the structure.

FIG. 3 is a side elevation view of a portion of a structure 50. The barrier 10 can be operatively connected to the structure 50 by a plurality of retainer elements 52. For purposes of this example, the barrier 10 can be operatively connected to the structure 50 by two retainer elements 52. The retainer elements 52 can be provided on opposite sides of a portion, region, or area of the structure 50. In one or more arrangements, the retainer elements 52 can be attached to an inside portion of the structure 50. In one or more arrangements, the retainer elements 52 can be attached to an outside portion of the structure 50. In one or more arrangements, the retainer elements 52 can be substantially parallel to each other. The retainer elements 52 can be oriented in a substantially vertical direction.

The retainer elements 52 can be operatively connected to the structure 50 in any suitable manner, such as by one or more fasteners and/or one or more forms of mechanical engagement. Additional examples of the operative connection between the retainer elements 52 and the structure 50 will be described herein. The retainer elements 52 can be operatively connected to the structure 50 so as to allow the retainer elements 52 to be selectively disconnected from the structure 50.

The barrier 10 can be retainably engaged by the retainer elements 52. More particularly, the opposing edge regions 20 of the barrier 10 can be received in respective retainer elements 52 and retainably engaged therein. As will be described in greater detail herein, the edge regions 20 of the barrier 10 can be slidable within the retainer elements 52.

In one or more arrangements, the upper edge side 18*a* of the barrier 10 can be free, that is, the majority of the upper edge side 18*a* is not received within another element. In one or more arrangements, the lower edge side 18*b* of the barrier 10 can be free. Alternatively, in one or more arrangements, the lower edge side 18*b* can be operatively connected to a portion of the structure 50 (e.g., a slab, girder, frame, and/or other structure). In one or more arrangements, the lower edge side 18*b* and/or the upper edge side 18*a* of the barrier 10 can be operatively connected to the structure 50 using any suitable manner of attachment, such as by using one or more fasteners, one or more strap and buckle arrangements, and/or one or more forms of mechanical engagement, just to name a few possibilities.

The retainer element 52 can be made of a plurality of retainer segments 54. The plurality of retainer segments 54 can be substantially identical to each other. Alternatively, one or more of the retainer segments 54 of a retainer element 52 can be different from the other retainer segments 54 in one or more respects.

There can be any suitable quantity of retainer segments 54. In one or more arrangements, the retainer elements 52 can include two or more retainer segments 54. In one or more arrangements, the retainer elements 52 can include three or more retainer segments 54. In one or more arrangements, the retainer elements 52 can include four or more retainer segments 54. The retainer elements 52 can have the same quantity of retainer segments 54.

The plurality of retainer segments 54 can be substantially aligned with each other, as is shown in FIG. 3. More particularly, in one or more embodiments, the plurality of retainer segments 54 can be substantially aligned with each other in a substantially vertical direction. The plurality of retainer elements 52 can be arranged in a substantially abutted manner. Thus, one or both longitudinal ends of the retainer segments 54 can substantially abut a longitudinal end of another retainer segment 54. Alternatively, one or more of the retainer elements 52 can be spaced from one or more neighboring retainer elements 52.

The retainer elements 52 and the retainer segments 54 can have any suitable configuration. The retainer segments 54 can have an elongated bodies and an associated longitudinal direction 56. The retainer segments 54 can be configured to receive at least a portion of the barrier 10 (e.g., the edge region 20). The retainer segments 54 can have an associated length. In one or more arrangements, the retainer element 52 can have a plurality of retainer segments 54 with substantially the same length. In one or more arrangements, the length of the retainer segments 54 can be substantially equal to the vertical length of one story of the structure 50. In one or more arrangements, the length of the retainer segments 54 can be less than the vertical length of one story of the structure. In one or more arrangements, the length of the retainer segments 54 can be about 4 meters or less. In one or more arrangements, the length of the retainer segments 54 can be about 3 meters or less. However, it will be understood that these lengths are provided merely as examples and the retainer segments 54 can have any suitable length, including lengths that are greater than or less than those described.

Figure 4:
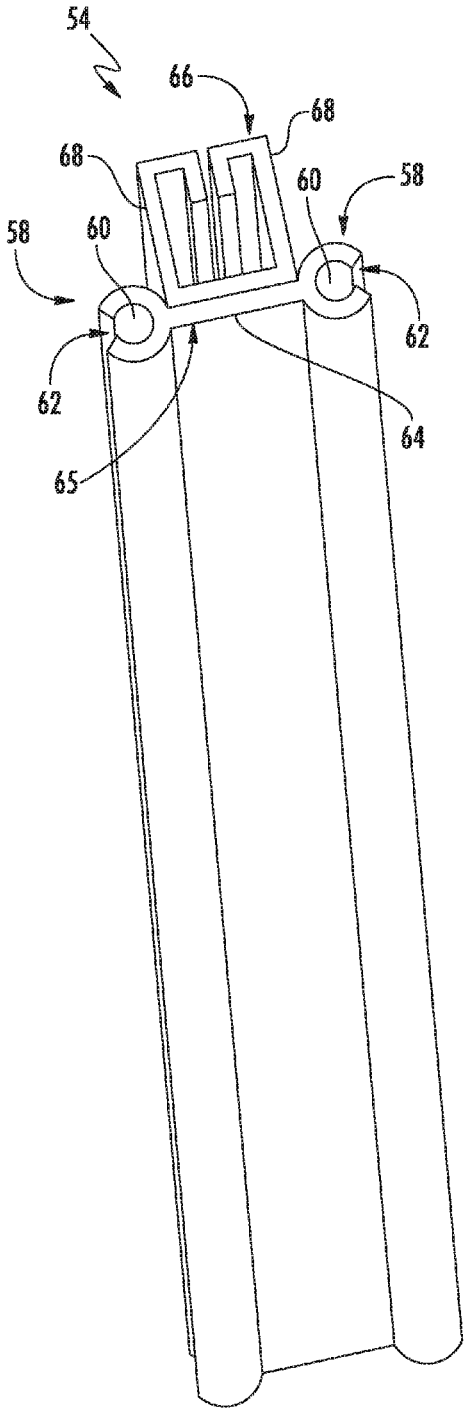
FIG. 4 is an example of a retainer segment, showing a first configuration of the retainer segment.

One example of a retainer segment 54 is shown in FIG. 4. The retainer segment 54 can include two channels 58. In one or more arrangements, the channels 58 can be configured as c-shaped or u-shaped channels. However, the channels 58 can have any suitable configuration. Each channel 58 can define a cavity 60. The cavity 60 can have any suitable size and/or cross-sectional shape. For instance, the cavity 60 can be substantially circular, substantially rectangular, or substantially polygonal, just to name a few possibilities. The cavity 60 can extend in the longitudinal direction 56 of the retainer segment 54. The cavity 60 can be sized to engage the edge region 20 of the barrier 10 therein (e.g., frictional engagement), while permitting the edge region 20 of the barrier to be selectively moved (e.g., sliding) within the cavity 60 in the longitudinal direction 56.

The cavity 60 can be in communication with the outside of the retainer segment 54. For instance, the retainer segment 54 can include an opening 62. The opening 62 can extend in the longitudinal direction 56 of the retainer segment 54. The opening 62 can have any suitable configuration.

In one or more arrangements, the channels 58 can be connected by a connecting member 64 to form a double channel retainer segment 65. The connecting member 64 can have any suitable configuration. In one or more arrangements, the connecting member 64 can be substantially straight. In one or more arrangements, the connecting member 64 can be non-straight in one or more places.

The double channel retainer segment 65 can be attached to a backing element 66. The backing element 66 can provide strength to the retainer segment 54. The double channel retainer segment 65 can be attached to the backing element 66 in any suitable manner, such as by one or more fasteners (e.g. screws), one or more adhesives, one or more forms of mechanical engagement, welding, brazing, and/or other suitable form of attachment. In one or more arrangements, the channels 58 can extend at least partly beyond the lateral sides 68 of the backing element 66, as is shown in FIG. 4. However, in other arrangements, the channels 58 may be aligned with the lateral sides 68 of the backing element 66. Still further, the channels 58 can be recessed from the lateral sides 68 of the backing element 66.

In the double channel retainer segment 65, the channels 58 can be arranged so that the openings 62 are oriented in generally opposite directions from each other, as is shown in FIG. 4. However, other orientations of the openings 62 are possible. For instance, the openings 62 can be oriented in one or more transverse directions to each other.

Figure 5:
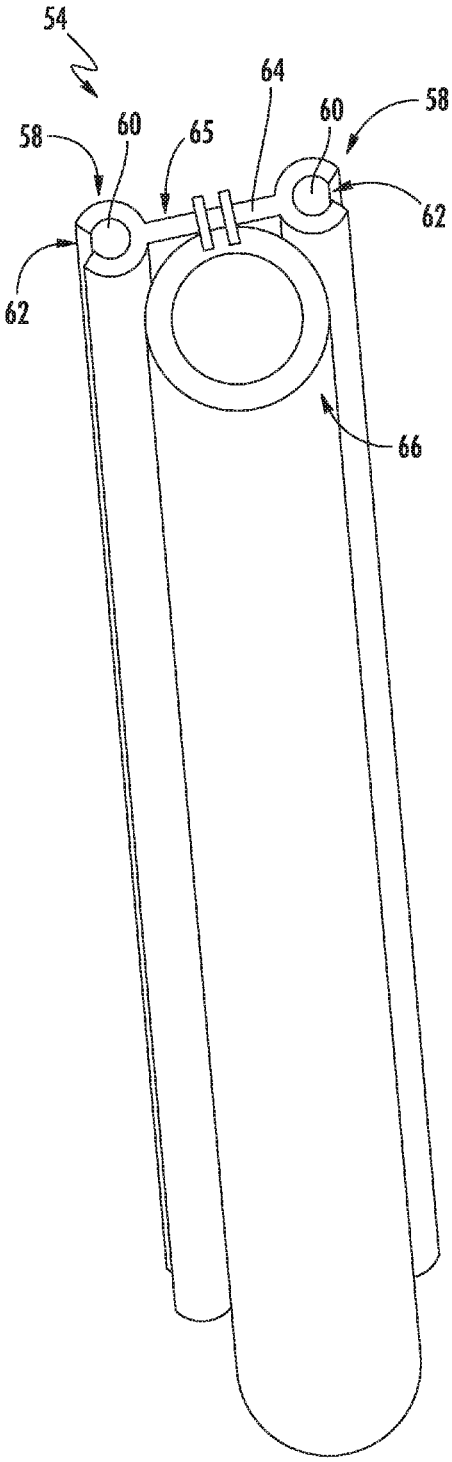
FIG. 5 is an example of a retainer segment, showing a second configuration of the retainer segment.

Another example of a retainer segment 54 is shown in FIG. 5. The retainer segment 54 can include two channels 58. The retainer segment 54 can include the double channel retainer segment 65. In the configuration shown in FIG. 5, the backing element 66 can be substantially circular. The backing element 66 can be solid. Alternatively, the backing element 66 can be hollow along its entire length or in one or more areas. However, it will be understood that arrangements described herein are not limited to substantially circular backing elements 66. The double channel retainer segment 65 can be attached to the backing element 66 in any suitable manner, such as by one or more fasteners (e.g. screws), one or more adhesives, one or more forms of mechanical engagement, welding, brazing, and/or other suitable form of attachment.

Figure 6:
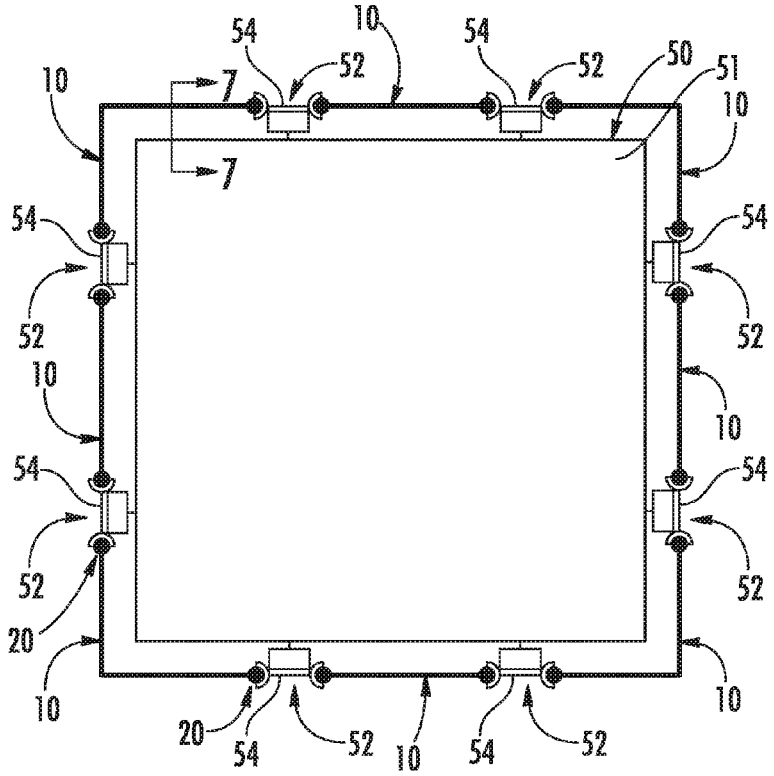
FIG. 6 is a plan view of one story of a structure having a plurality of stories, showing a plurality of barriers operatively connected about the perimeter of the structure by a plurality of retainer elements.

Arrangements described herein can be used in connection with a structure having a plurality of stories. FIG. 6 is a plan view of one story of a structure 50 having a plurality of stories (e.g., floors, levels, etc.). The arrangements shown and/or described in connection with FIG. 6 can be used in connection with any of the stories of the structure 50. The structure includes a slab 51. In the view shown, the slab 51 can define a lower portion of a respective story of the structure 50.

A plurality of barriers 10 can be operatively connected about at least a portion of the perimeter of the structure 50 by a plurality of retainer elements 52. It should be noted that the plurality of barriers 10 can be substantially identical to each other. Alternatively, one or more of the barriers 10 can be different from the other barriers 10 in one or more respects, including, for example, width, thickness, length, and/or material, just to name a few possibilities.

While FIG. 6 shows a plurality of barriers 10 and retainer elements 52 arranged about the entire perimeter of the structure 50, it will be understood that arrangements described herein are not limited in this respect. Indeed, one or more barriers 10 and retainer elements 52 can be arranged about a portion of the perimeter of the structure 50.

The retainer elements 52 can be distributed about the perimeter of the structure in any suitable manner. For instance, the retainer elements 52 can be substantially equally spaced. Alternatively, at least one of the retainer elements 52 can be non-equally spaced relative to the other retainer elements 52.

The plurality of retainer elements 52 can be substantially identical to each other for the story shown and/or for all stories in which the retainer elements 52 are used. Alternatively, one or more of the plurality of retainer elements 52 can differ from the other retainer elements 52 in one or more respects.

The retainer element 52 can be oriented in any suitable manner. For instance, the retainer elements 52 can be oriented so that their longitudinal direction 56 extends in a substantially vertical orientation. The retainer elements 52 can be substantially parallel to each other.

The opposing edge regions 20 of each barrier 10 can be retainably engaged by neighboring pairs of retainer elements 52, as shown in FIG. 6. For instance, one edge region 20 of the barrier 10 can be received in the channel of a first retainer element 52, and the opposite edge region 20 of the barrier 10 can be received in the channel of a second retainer element 52. In the arrangement shown in FIG. 6, each retainer element 52 can engage two different barriers 10. In some instances, one or more of the barriers 10 can extend about a corner of the structure 50. In some instances, a retainer element 52 can be provided at or near one or more of the corners of the structure 50. The barrier 10 can be slidable within the channels of the retainer elements 52. Thus, the barriers 10 shown in FIG. 6 can be slidable into and/or out of the page.

The barrier 10 can be spaced from the structure 50, as is shown in FIG. 6. Alternatively, the barrier may directly contact the structure 50 in one or more places or about the perimeter of the structure 50.

Figure 7:
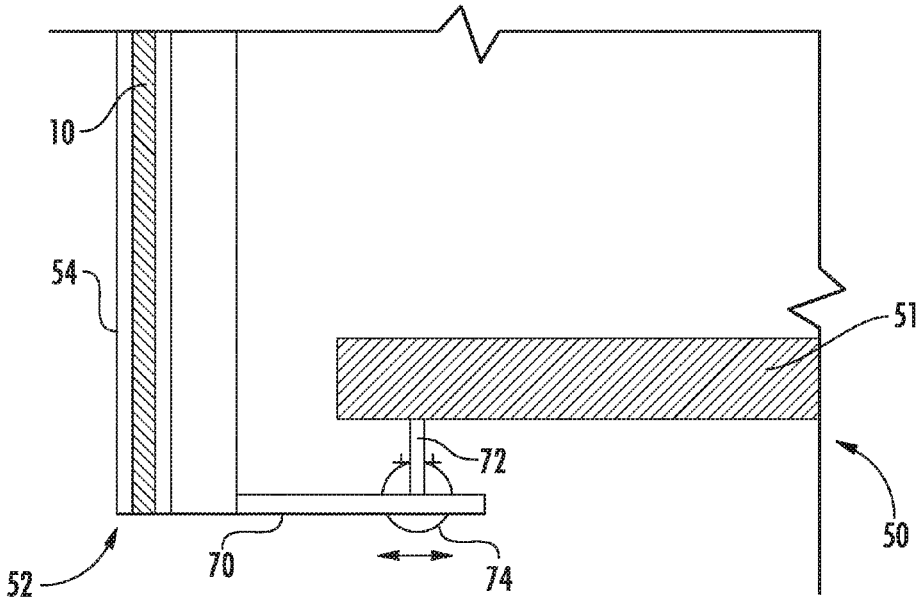
FIG. 7 is a cross-sectional side elevation view of the structure, viewed along line 7-7 in FIG. 6, and showing a barrier operatively connected to the structure by a retainer element.

FIG. 7 is a cross-sectional side elevation view of a structure, viewed along line 7-7 in FIG. 6. As shown, the barrier 10 is operatively connected to the structure 50 by the retainer element 52. The retainer element 52 can be directly or indirectly attached to a suitable portion of the structure 50 in any suitable manner. In one or more arrangements, the retainer element 52 can be operatively connected to the structure 50 by a spacing element (e.g. a strut 70, member, rod, etc.) to provide appropriate spacing off of the edge of a slab 51. In such case, the spacing element can extend at about 90 degrees relative to the longitudinal direction 56 of the retainer element 52. However, it will be appreciated that, in one or more arrangements, the length of the spacing element may result in the barrier 10 directly contacting the slab 51.

The spacing element can be operatively connected to the retainer element 52 in any suitable manner, such as by one or more fasteners, one or more forms of mechanical engagement, welding, brazing, and/or one or more adhesives, just to name a few possibilities. The spacing element can be operatively connected to the structure 50 in any suitable manner. For instance, the spacing element can be operatively connected to the slab 51, a girder 72, framework, and/or other suitable structure. In one or more arrangements, the spacing element can be operatively connected to a girder 72 by one or more suitable fasteners (e.g., a clamp 74, screw, tie, etc.). The clamp 74 can be movable along the length of the spacing element. The position of the clamp 74 along the spacing element can be locked by, for example, one or more fasteners.

While FIG. 7 shows the spacing element being attached to a girder 72 located on an underside of the slab 51, it will be appreciated that the spacing element and/or the retainer element 52 can be operatively connected to the structure 50 in any suitable location. For instance, the spacing element and/or the retainer element 52 can be attached to an upper side of the slab 51 or a structure located on the upper side of the slab 51. As a further example, the spacing element and/or the retainer elements 52 can be attached to the side edge of the slab 51 or a structure located on the side edge of the slab 51.

Now that the various potential systems, devices, elements and/or components have been described, various methods of using such systems, devices, elements and/or components will now be described. Various possible steps will now be described. The description may be applicable to the embodiments described above in relation to FIGS. 1-7 (and/or FIGS. 9-13), but it is understood that the method can be carried out with other suitable systems and arrangements. Moreover, the method may include other steps that are not shown here, and in fact, the method is not limited to including every step described herein. The steps described are not limited to a particular chronological order. Indeed, some of the steps may be performed in a different order than what is shown and/or at least some of the steps shown can occur simultaneously.

FIGS. 8A-8D are side elevation views of a portion of a structure with simplified schematic depictions of the arrangements described herein. The arrangements shown in FIGS. 8A-8D are used to facilitate the description, but embodiments are not limited to these arrangements.

The structure 80 can have a plurality of stories. For purposes of this example, the structure 80 can have at least five stories: a first story 82, a second story 84, a third story 86, a fourth story 88, and a fifth story 90. However, arrangements described herein can be implemented with structures having fewer stories (e.g. two, three or four) as well as structures with more than five stories (e.g., six, seven, eight, etc.). The stories 82, 84, 96, 88, 90 can be separated by a slab 92. The first story 82 of the structure 80 can include or can be at least partially defined by a ground slab 94.

Figure 8A:
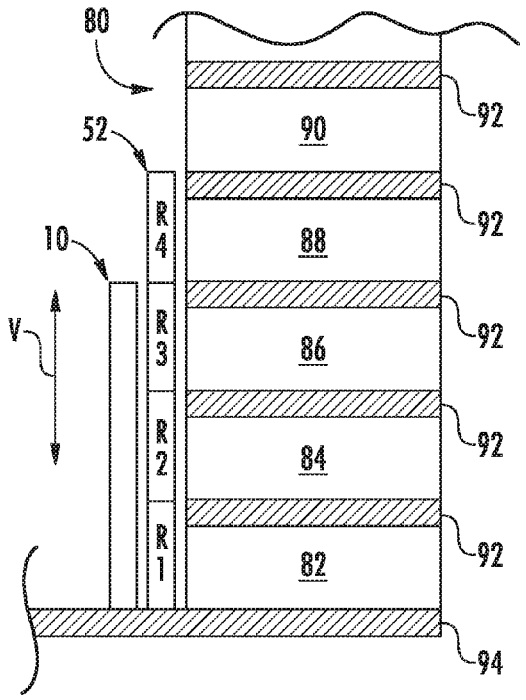
FIGS. 8A-8D are side elevation views of a portion of a structure, showing a simplified schematic depictions of the movement of a barrier and retainer segments according to arrangements described herein.
Figure 8B:
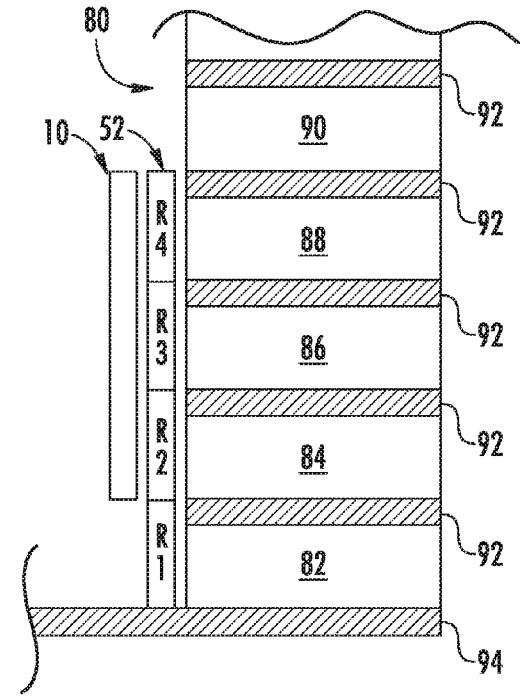

Referring to FIG. 8A, the barrier 10 can span about three stories in the vertical direction V. However, it will be understood that this is merely an example. In some instances, the barrier 10 can vertically span fewer than three stories (e.g. one or two). In some instances, the barrier 10 can vertically span more than three stories (e.g. four, five, six, or more). The retainer element 52 can include four retainer segments R1, R2, R3, R4. However, it will be understood that this is merely an example. In some instances, the retainer element 52 can include fewer than four retainer segments (e.g., two or three). In some instances, the retainer element 52 can more than four retainer segments (e.g., five, six, or more).

Each retainer segment can span about one story of the structure 80 in the vertical direction V. A plurality of retainer segments can be stacked in the vertical direction V. The quantity of retainer segments 54 in each retainer element 52 can be equal to n+1 wherein n is the number of stories that the barrier 10 substantially spans in the vertical direction V. In the example shown in FIGS. 8A-8D, the barrier 10 can span about three stories in the vertical direction V. Thus, there can be four retainer segments R1, R2, R3, R4 stacked substantially in the vertical direction V. The retainer segments 54 can be arranged such that channels 58 provided by the retainer segments 54 are substantially aligned.

The plurality of retainer segments R1, R2, R3, R4 can be removably attached to a respective portion of the structure 80. The plurality of retainer segments R1, R2, R3, R4 stacked in substantially the vertical direction V can be substantially aligned with each other. In one or more arrangements, the neighboring retainer segments R1, R2, R3, R4 can substantially abut each other. Thus, the longitudinal ends of the neighboring retainer segments R1, R2, R3, R4 can directly contact each other or have a minimal spacing between them. In one or more arrangements, the neighboring retainer segments R1, R2, R3, R4 can be spaced from each other. Such spacing can include an air gap or a gap formed by an intermediate element, as will be described herein. Such gaps can be beneficial, in at least some instances, by allowing slidability of the barrier 10 within the retainer segments even when the neighboring retainer segments may be misaligned. In one or more arrangements, the retainer segments R1, R2, R3, R4 can be attached to each other. In one or more arrangements, the retainer segments R1, R2, R3, R4 may not be attached to each other.

The plurality of retainer segments R1, R2, R3, R4 can be substantially identical to each other. Alternatively, one or more of the plurality of retainer segments R1, R2, R3, R4 can differ from the other retainer segments in one or more respects.

To facilitate alignment of the retainer segments 54, any suitable splice or a bridging member can be used. Such an element can span across the junction between neighboring retainer segments 54. For instance, a portion of such an element can be received in the first retainer segment R1 (e.g. the channel and/or the backing element thereof) and a portion of such an element can be received in the second retainer segment R2 (e.g. the channel and/or the backing element thereof).

In FIG. 8A, there can be four retainer segments R1, R2, R3, R4 stacked in substantially the vertical direction V corresponding to the first, second, third and fourth stories 82, 84, 86, 88 of the structure 80. In one or more arrangements, the retainer segments R1, R2, R3, R4 can be operatively connected to a respective portion of the structure 80. For instance, the retainer segments R2, R3, R3 can be operatively connected to a respective slab 92 of the structure. The retainer segment R1 can be operatively connected to the ground slab 94, or the retainer segment R1 may be supported on the ground slab 94 without being operatively connected thereto.

The barrier 10 can be brought together with the retainer elements 52. "Brought together" means that the barrier 10 and/or the retainer elements 52 are moved, manipulated, positioned, and/or arrangements. The barrier 10 can be retainably engaged by retainer elements R1, R2, R3. The barrier 10 can cover a portion of the first, second and third stories 82, 84, 86 of the structure 80. In the arrangement shown in FIG. 8A, the retainer segment R4 does not substantially engage and/or does not substantially receive the barrier 10. It should be noted that a stopper element (e.g. a pin, screw, or other structure) can pass through a hole or opening in any of the retainer elements and into engagement with the barrier 10. The stopper element can help to hold the barrier 10 up and/or to prevent sagging of the barrier 10 in at least the vertical direction V.

It should be noted that, in one or more arrangements, the barrier 10 can be configured with one or more features that can minimize objects or people from falling off of the structure. For example, in one or more arrangements, one or more flaps (not shown) can be provided on the inner major side 16 of the barrier 10. The flap can be made of a single piece of material or separate pieces of material. The flap can be attached to the main body 12 of the barrier 10 in any suitable manner, such as by stitching, one or more adhesives, and/or one or more fasteners, just to name a few possibilities.

The flap can have any suitable size, shape, and/or configuration. In one or more arrangements, the flap can be about 2 feet wide. In one or more arrangements, the one or more flaps can be positioned on the barrier 10 for attachment to a slab 92, 94 of the structure 80. When the barrier 10 is retainably engaged by the retainer elements 52, the flaps can be supported on and/or can be positioned to be supported on the slab 92, 94 (e.g., on the upper side of the slab 92, 94). The flap can be attached to the slab 92, 94 in any suitable manner, such as by using one or more fasteners. The flaps can be provided for each of the stories of the structure 80. It will be appreciated that such flaps or other structures can minimize people and/or things from falling out of the building by creating a physical barrier.

The arrangement shown in FIG. 8A can be provided about at least a portion of the perimeter of the structure 80. In one or more arrangements, the arrangement shown in FIG. 8A can be provided about the entire perimeter of the structure 80, such as is shown in FIG. 6.

In one implementation, any suitable work can be performed on the structure 80 while the barrier 10 is in place. For instance, portions of the structure 80 can be sprayed for fire resistance purposes. In such case, the barrier 10 can help to minimize and/or prevent overspray. When completed, the barrier 10 can be slid upward within the retainer elements 52 in substantially the vertical direction V to the position shown in FIG. 8B. Here, the barrier 10 can be retainably engaged by retainer segments R2, R3, R4. Again, one or more stopper elements can be used to facilitate holding the barrier 10 in this vertical position. The barrier 10 can cover at least a portion of the second, third, and fourth stories 84, 86, 88 of the structure 80. Here, retainer segment R1 no longer retainably engages the barrier 10 and/or does not substantially receive the barrier 10.

Figure 8C:
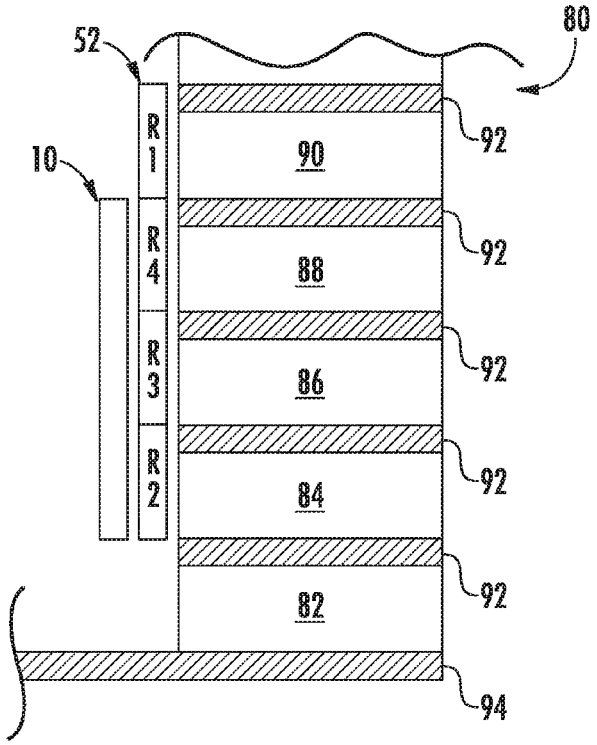
Figure 8D:
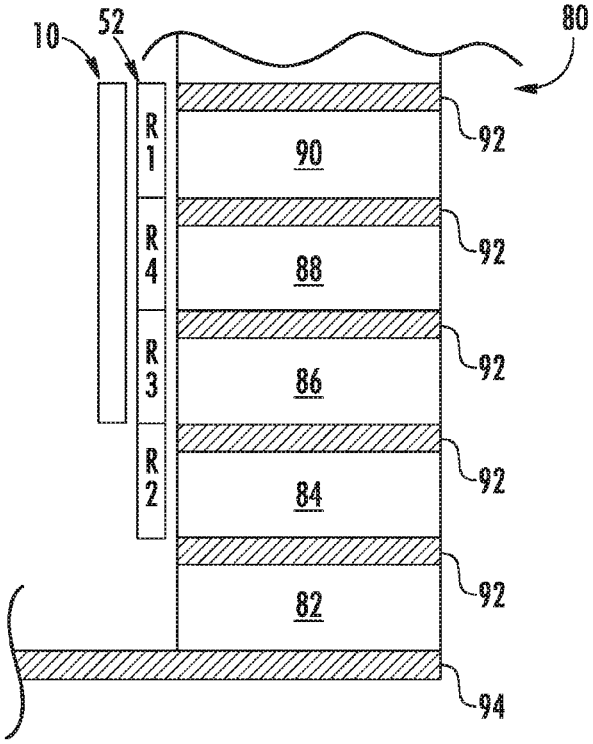

Referring to FIG. 8C, the retainer segment that no longer retainably engages the barrier 10 can be disconnected from the structure 80 and can be moved. In this example, retainer element R1 can be detached from the structure 80, and it can be moved upward to the next available story in the substantially vertical direction V. In this example, the retainer segment R1 can be moved to the fifth story 90. The retainer segment R1 can be attached to any suitable portion of the structure 80. For instance, the retainer segment R1 can be attached to the slab 92 associated with the fifth story 90 of the structure. The retainer element R1 can be substantially aligned with retainer segment R4 and/or retainer elements R3, R2. The substantially aligned retainer segments R1, R4, R3, R2 can collectively define a channel within which the barrier 10 can slide.

Again, work can continue on the structure as needed. When completed, the barrier 10 can be slid upwardly within the channels in substantially the vertical direction V to the position shown in FIG. 8D. Here, the barrier 10 can be retainably engaged by retainer segments R3, R4, R1. The barrier 10 can cover a portion of the third, fourth and fifth stories 86, 88, 90 of the structure 80. Retainer element R2 no longer engages the barrier.

The above process can repeat until the last story or a desired story of the structure is reached or completed. When the top story of the structure 80 is reached, the retainer segments can continue to be stacked in the vertical direction beyond the actual top story of the structure 80.

In one or more arrangements, intermediate attachments for the barrier 10 can be provided in one or more directions along the width and/or height of the barrier 10. The intermediate attachments can have any suitable form and can attach to any suitable portion of the structure 80. The intermediate attachments can help to reduce loading on the edges of the barrier 10. For instance, when there are two intermediate attachments along the width of the barrier 10, intermediate attachments can help to reduce loading on the edges of the barrier 10 by about two thirds. In one or more arrangements, the intermediate attachments can divide the barrier 10 into three parts—vertically for positive loads and horizontally for negative loads. The slab rests can reduce positive loading. The intermediate attachments can be made to existing deweydags or other suitable structure can reduce negative loading.

The intermediate attachments can have any suitable form. In one or more arrangements, the intermediate arrangements can be a buckle and strap combination. However, other intermediate attachments are possible.

The retainer elements 52 can also facilitate the sliding of the barrier 10 up (or down if needed), one floor/story at a time. The retainer segments can span from slab to slab in the vertical direction V. The barrier 10 can be slid up one floor at a time by lifting from a top portion of the barrier 10 and sliding into an opposing pair of retainer elements preinstalled on the next floor above. The sliding of the barrier 10 can be performed in any suitable manner. In one implementation, the barrier 10 can be slid up manually by human workers and/or by using a machine or device (e.g., a winch, a pulley, etc.).

Additional elements (e.g., one or more ropes, one or more straps, one or more ties, etc.) can be used to facilitate the sliding of the barrier 10. For instance, in one or more arrangements, a rope can be attached to the barrier 10, and the barrier 10 can be pulled up one story at a time using the rope. The barrier 10 can have one or more features to facilitate such actions. For example, one or more holes and/or grommets can be provided in the barrier 10, such as near the upper edge side 18*a* of the barrier 10.

Figure 9:
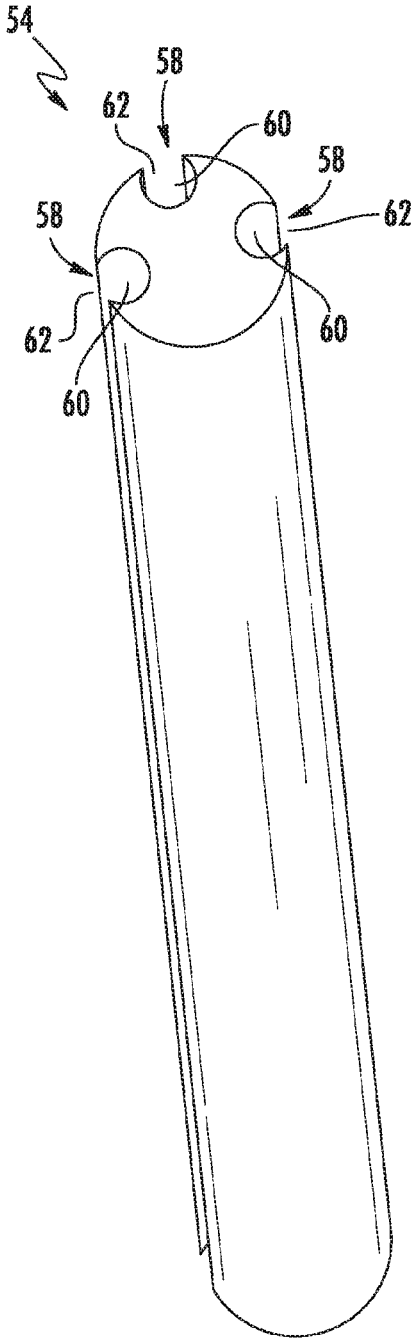
FIG. 9 is an example of a retainer segment, showing a third configuration of the retainer segment.

One example of a retainer segment 54 is shown in FIG. 9. The retainer segment 54 can include three channels 58. In one or more arrangements, the channels 58 can be configured as c-shaped or u-shaped channels. However, other shapes are possible for the channels 58. Each channel 58 can define a cavity 60. The cavity 60 can have any suitable size and/or cross-sectional shape. For instance, the cavity 60 can be substantially circular, substantially rectangular, or substantially polygonal, just to name a few possibilities. The cavity 60 can extend in the longitudinal direction 56 of the retainer segment 54.

The cavity 60 can be in communication with the outside of the retainer segment 54. For instance, the retainer segment 54 can include an opening 62. The opening 62 can extend in the longitudinal direction 56 of the retainer segment 54. The opening 62 can have any suitable configuration.

The channels 58 can be distributed about the retainer segment 54 in any suitable manner. For instance, the channels 58 can be substantially equally spaced about the retainer segment 54. Alternatively, the spacing between the channels 58 can be non-equal. In one or more arrangements, the channels 58 can be arranged at substantially 90 degrees relative to each other, as is shown in FIG. 9. In such case, two of the channels 58 can be opposite to each other (e.g., at about 180 degrees relative to each other), as is shown.

In one or more arrangements, the retainer segment 54 can be a solid structure. In one or more arrangements, at least a portion of the retainer segment 54 can be hollow. In one or more arrangements, the retainer segment 54 can be hollow along its entire length. The retainer segment 54 can be made of any suitable material, such as, for example, aluminum. The retainer segment 54 can be made in any suitable manner, such as by extrusion.

The retainer segment 54 shown in FIG. 9 can be beneficial in several respects. For instance, the retainer segment 54 can be used along the sides of a structure to which the retainer segments 54 are operatively connected. In addition, the retainer segment 54 can be used at corners of the structure. Thus, the retainer segment 54 allows flexibility in its use and can minimize the number of unique parts.

Figure 10:
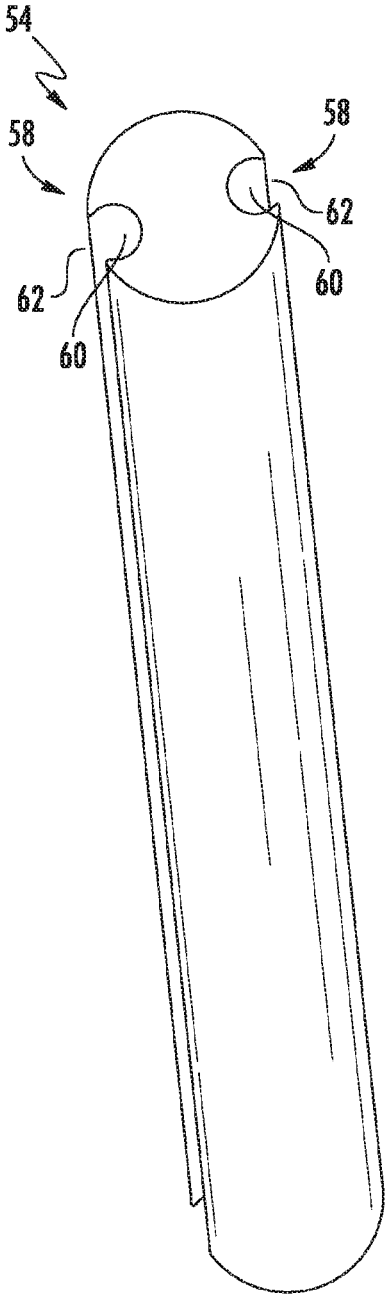
FIG. 10 is an example of a retainer segment, showing a fourth configuration of the retainer segment.

Another example of a retainer segment 54 is shown in FIG. 10. The retainer segment 54 can include two channels 58. The channels 58 can be arranged opposite to each other (e.g., at about 180 degrees relative to each other), as is shown. The discussion of various aspects of the retainer segment 54 in FIG. 9 is equally applicable to the retainer segment in FIG. 10. The retainer segment 54 shown in FIG. 10 can be useful along the sides of a structure to which the retainer segments 54 are operatively connected. The retainer segments 54 in FIG. 10 can be used separately, or they can be used in combination with the retainer segments 54 in FIG. 9 or any other type of retainer segment.

Figure 11:
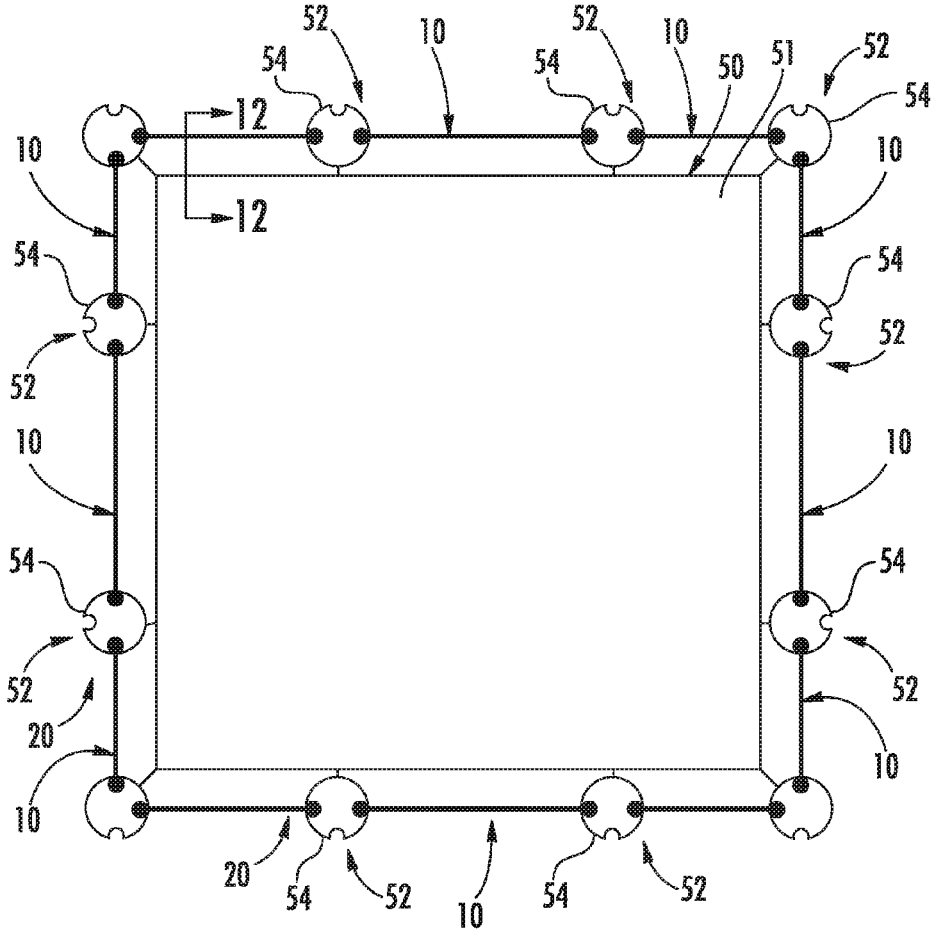
FIG. 11 is a plan view of one story of a structure having a plurality of stories, showing a plurality of barriers operatively connected about the perimeter of the structure by a plurality of retainer elements.

The retainer segments 54 shown in FIGS. 9 and 10 can be used in connection with a structure having a plurality of stories. FIG. 11 is a plan view of one story of a structure 800 having a plurality of stories. The above description of FIG. 7 applies equally to FIG. 11 and the use of the retainer segments 54 shown in FIGS. 9 and 10. Further, FIG. 11 shows an example in which retainer segments are provided at the corners of the structure 80.

Figure 12:
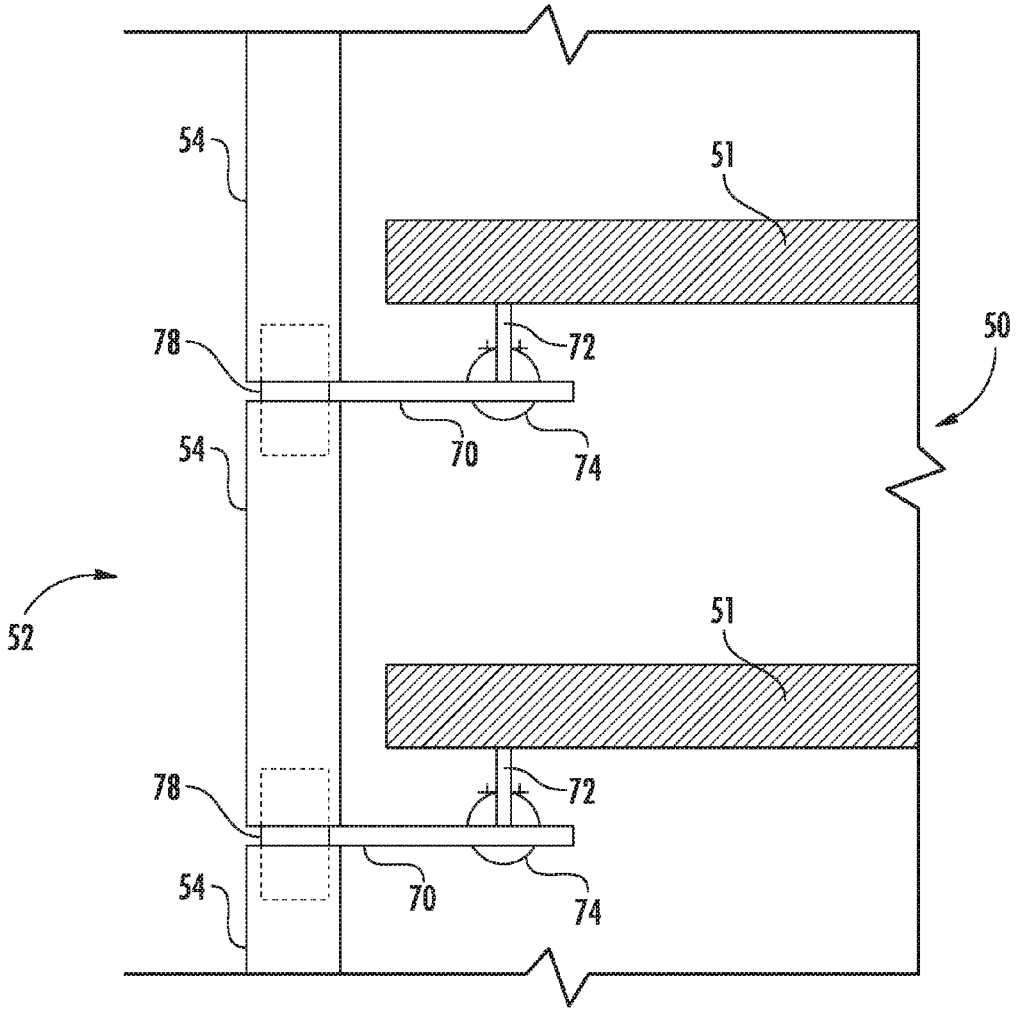
FIG. 12 is a cross-sectional side elevation view of the structure, viewed along line 12-12 in FIG. 11, showing a plurality of barriers operatively connected to the structure by a plurality of retainer elements.

FIG. 12 is a cross-sectional side elevation view of a structure, viewed along line 12-12 in FIG. 11. As shown, the barrier 10 is operatively connected to the structure 50 by the retainer element 52. The retainer element 52 can be directly or indirectly attached to a suitable portion of the structure 50 in any suitable manner. In one or more arrangements, the retainer element 52 can be operatively connected to the structure 50 by a spacing element (e.g. a strut 70, member, rod, etc.) to provide appropriate spacing off of the edge of a slab 51. In such case, the spacing element can extend at about 90 degrees relative to the longitudinal direction 56 of the retainer element 52. In some instances, there may not be a spacing between the barrier 10 and the edge of the slab 51 and/or the structure 50.

The spacing element can be operatively connected to the retainer element 52 in any suitable manner. For instance, the spacing element can include a connector 78 on the distal end thereof. The connector 78 can be sized so as to be received partially within neighboring retainer segments 54, as is shown in FIG. 12. Alternatively, the connector 78 can be sized such that the neighboring retainer segments are at least partially received in the connector 78. The connector 78 can have any suitable configuration. It should be noted that the use of the connector 78 can result in the neighboring retainer segments 54 being spaced apart. As a result, there may be portions of the edge regions 20 of the barrier 10 that are not received in a channel at such locations. Such spacing can facilitate the sliding of the barrier 10 within the channels.

The above discussion of the operative connection between the spacing element and the structure 50 described in connection with FIG. 7 is equally applicable here. It should be noted that the method described in connection with FIGS. 8A-8D is equally applicable to the arrangements shown in FIG. 12.

Figure 13:
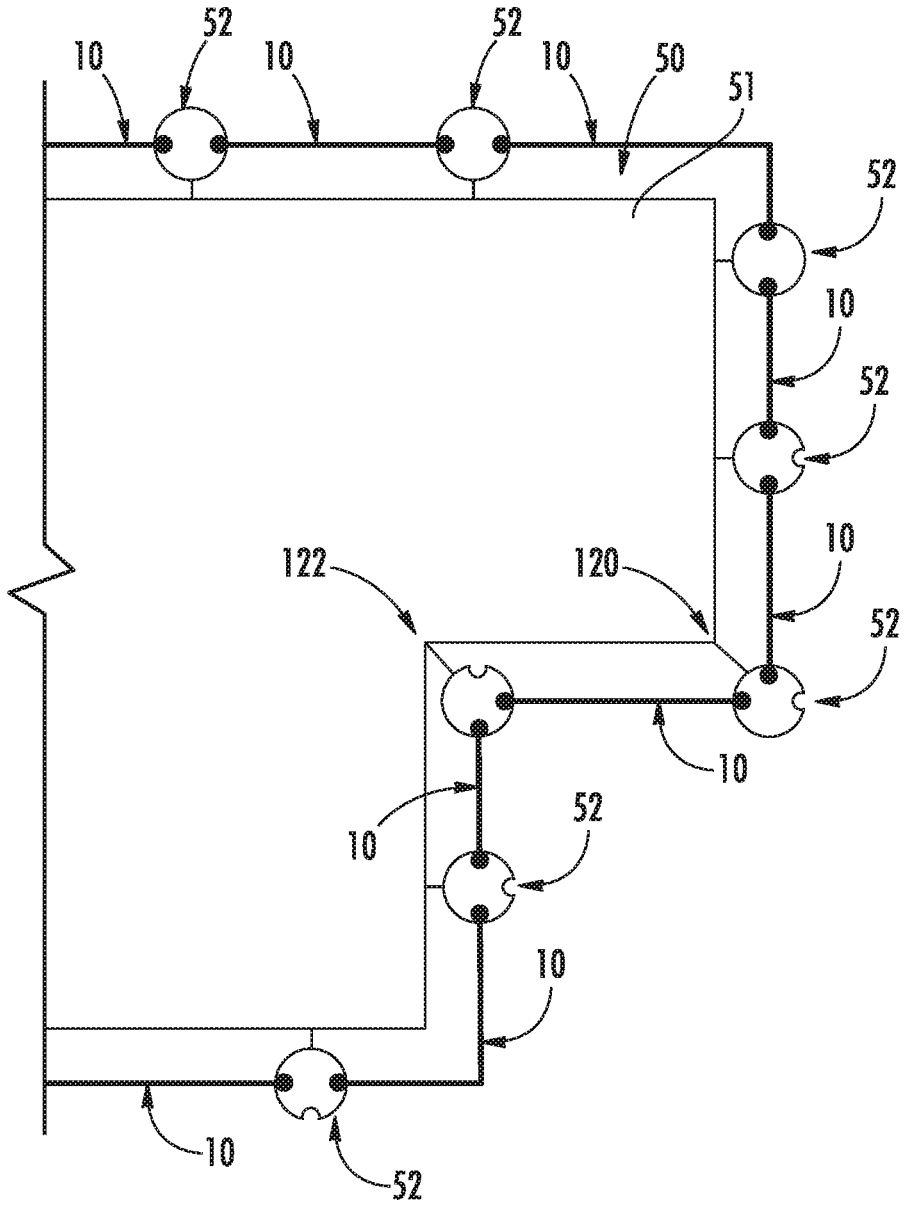
FIG. 13 is a plan view of a portion of one story of a structure having a plurality of stories, showing a plurality of barriers operatively connected about an irregular perimeter of the structure by a plurality of retainer elements.

Arrangements described herein can be used in connection with structure having stories that are any shape, including, for example, circular, triangular, trapezoidal, parallelogram, polygonal, oval, stepped, irregular, etc. While the previously described arrangements have been used in connection with stories that are substantially rectangular, it will be appreciated that arrangements are not limited in this respect. Indeed, FIG. 13 is a plan view of a portion of one story of a structure 50. The story shown in FIG. 13 stepped. A plurality of barriers 10 can be operatively connected about an irregular perimeter of the structure by a plurality of retainer elements.

FIG. 13 shows various alternatives that can be implemented. For instance, FIG. 13 shows the use of both the three channel retainer segments 54 shown in FIG. 9 as well as the two channel retainer segments shown in FIG. 10. Further, FIG. 13 shows the use of retainer segments 54 at an exterior corner 120 and an interior corner 122 of the structure. FIG. 13 shows some corners in which the retainer segments 54 are not used. FIG. 13 also shows the use of barriers 10 that have different widths. In other arrangements, the plurality of barriers 10 can be substantially the same size.

It will be appreciated that, as a result of arrangements described herein, one or more of the following benefits and/or other benefits can be realized. Arrangements described herein can streamline the process of constructing a structure having a plurality of stories. Arrangements described herein can allow higher stories of the structure to be covered efficiently as the work progresses to those stories. Arrangements described herein can be used as tarping to prevent overspray from any spray process that may be used (e.g., fireproofing spray). Arrangements described herein can be used to protect people of the environment outside of the structure from objects and things from falling out of the structure. Arrangements described herein can be used to protect construction personnel and/or other workers from falling out of the building. Arrangements described herein can protect the structure and people or things within the structure from the environment (e.g., sun, rain, high winds, sand storms, etc.). Arrangements described herein can be reusable. Arrangements described herein can allow daylight into the structure and/or can allow the passage of air through the structure, thereby providing comfort to people within the structure.

The terms "a" and "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language).

Aspects described herein can be embodied in other forms and combinations without departing from the spirit or essential attributes thereof. Thus, it will of course be understood that embodiments are not limited to the specific details described herein, which are given by way of example only, and that various modifications and alterations are possible.

What is claimed is:

1. A slidable barrier method for a structure having a plurality of stories, the method comprising:

operatively connecting a first retainer element to the structure, the first retainer element extending in a substantially vertical direction, the first retainer element spanning a plurality of stories of the structure, the first retainer element including a plurality of retainer segments, the plurality of retainer segments including an uppermost retainer segment and one or more lower retainer segments, the one or more lower retainer segments including a lowermost retainer segment; and bringing a barrier and the first retainer element together such that a portion of the barrier is retainably engaged with the one or more lower retainer segments of the first retainer element, the barrier having an associated length, the length of the barrier substantially corresponding to a length of the lower retainer segments, the uppermost retainer segment extending above an upper edge side of the barrier in the substantially vertical direction;

moving the barrier upwardly within the first retainer element such that the barrier is retainably engaged with the uppermost retainer segment and such that the barrier is no longer retainably engaged with the lowermost retainer segment;

disconnecting the lowermost retainer segment from the structure; and operatively connecting the disconnected retainer segment to the structure in a location above the uppermost retainer segment in the substantially vertical direction to become a new uppermost retainer segment, wherein the barrier is not retainably engaged by the new uppermost retainer segment, and wherein the previous uppermost retainer segment becomes included in the one or more lower retainer segments.

2. The method of claim 1, further including:

operatively connecting a second retainer element to the structure, the second retainer element extending in a substantially vertical direction and being substantially parallel to the first retainer element, the second retainer element spanning a plurality of stories of the structure, the second retainer element including a plurality of retainer segments, the plurality of retainer segments including an uppermost retainer segment and one or more lower retainer segments, the one or more lower retainer segments including a lowermost retainer segment; and bringing the barrier and the second retainer element together such that a second portion of the barrier is retainably engaged with the one or more lower retainer segments of the second retainer element, the length of the barrier substantially corresponding to a length of the lower retainer segments of the second retainer element, the uppermost retainer segment of the second retainer element extending above the upper edge side of the barrier in the substantially vertical direction.

3. The method of claim 1, wherein moving the barrier upwardly includes sliding the barrier through a channel provided in the first retainer element.

4. The method of claim 1, wherein moving the barrier upwardly within the first retainer element includes:

attaching one or more elements to a portion of the barrier; and pulling the barrier upwardly using the one or more elements.

5. The method of claim 1, wherein the plurality of retainer segments are arranged in an abutting manner.

6. The method of claim 1, wherein the plurality of retainer segments are spaced from each other.

* * * * *